US009848659B2

(12) United States Patent
Rudick

(10) Patent No.: US 9,848,659 B2
(45) Date of Patent: Dec. 26, 2017

(54) LOAD-BEARING JACKET

(71) Applicant: Rudick Enterprises Inc., Brooklyn Park, MN (US)

(72) Inventor: Luke Rudick, Brooklyn Park, MN (US)

(73) Assignee: Rudick Enterprises Inc., Brooklyn Park, MN (US)

( * ) Notice: Subject to any disclaimer, the term of this patent is extended or adjusted under 35 U.S.C. 154(b) by 196 days.

(21) Appl. No.: 14/744,252

(22) Filed: Jun. 19, 2015

(65) Prior Publication Data

US 2015/0366273 A1 Dec. 24, 2015

Related U.S. Application Data

(60) Provisional application No. 62/014,533, filed on Jun. 19, 2014.

(51) Int. Cl.
*A41D 13/00* (2006.01)
*A41D 13/005* (2006.01)

(52) U.S. Cl.
CPC ..... *A41D 13/0012* (2013.01); *A41D 13/0007* (2013.01); *A41D 13/0015* (2013.01); *A41D 13/0058* (2013.01); *A41D 2600/20* (2013.01)

(58) Field of Classification Search
CPC ..... A45F 3/005; A45F 2300/144; A45F 5/02–2005/028; A45F 2200/00–2200/0591; A41D 27/04; A41D 2600/106; A41D 2600/108; A41D 2600/20
See application file for complete search history.

(56) References Cited

U.S. PATENT DOCUMENTS 5,909,802 A * 6/1999 Puco ..... A45F 3/04 2/102
2003/0159194 A1* 8/2003 Frank ..... A41D 13/0012 2/102
2003/0172431 A1* 9/2003 Allen ..... A41D 13/0007 2/69
2004/0211690 A1* 10/2004 Ho ..... A45F 3/14 206/373
2008/0098500 A1* 5/2008 Matic ..... F41H 1/02 2/2.5
2010/0031415 A1* 2/2010 Shadid ..... A41D 13/0012 2/87
2013/0167286 A1* 7/2013 Hudson ..... A41D 1/04 2/102

* cited by examiner

*Primary Examiner* — Khaled Annis
(74) *Attorney, Agent, or Firm* — Grumbles Law PLLC; Brittany Nanzig

(57) ABSTRACT

A load-bearing jacket. More specifically, a jacket comprising an outer layer made of heavy-duty cloth material, removable jacket sleeves, a vest shell, a removable vest liner, an integrated connector system, and an integrated tool belt system. The integrated tool belt system, in some embodiments, includes at least one belt strap permanently affixed to the jacket on one end and having a locking system on the other end.

17 Claims, 3 Drawing Sheets

LOAD-BEARING JACKET

BACKGROUND

Workers in various fields require quick access to tools or equipment. For example, construction workers frequently wear a tool belt around their waist or a tool suspender system. These belts permit various pouches and tools to be attached for quick and easy access during construction. Additionally, workers such as police, military personnel, or photographers require quick access to often-heavy equipment in time-sensitive situations.

Current tool belts or suspender systems have several drawbacks. In cold weather, outdoor workers typically wear a jacket in addition to a tool belt, and the tool belt often gets in the way. For example, if the worker chooses to wear the belt over his jacket, the jacket may lift out from under the belt and cover the tool belt when the worker lifts his arms up. Additionally, the tool belt may slide further down the worker's waist, and the tools may become less accessible. Consequently, the worker must readjust his tool belt every time he lifts his arms up. In another example, if a worker chooses to wear the tool belt under his jacket to ensure the tool belt is always snug, the worker must reach under his jacket to access his tools.

One existing alternative to a tool belt is a suspender system. However, suspender systems also have drawbacks. Because the weight of all of the tools has been taken off of a belt, the weight is now placed on shoulder straps that dig into a worker's shoulders. This creates pressure and abrasion points on the worker's shoulders. Additionally, suspender systems frequently involve the use of several straps, which increases the opportunity for entanglement when a worker is in a tight space or brushes up against non-smooth surfaces. Therefore, a new product is needed that enables workers to efficiently access tools while staying warm in cold or cool weather.

BRIEF SUMMARY OF THE INVENTION

The disclosed product is, generally, a load-bearing jacket with a built in tool belt system that enables a user to mount various tool pouches to the jacket. In one embodiment, the jacket has the tool belt system incorporated into the jacket at the waist area, has a removable liner for warmth in cold or cool weather, and has removable sleeves. The disclosed jacket ensures that a worker will stay warm while working outside, it decreases possibilities of entanglement on straps, and it is less likely to cause abrasion than current tool belt systems.

DETAILED DESCRIPTION

Figure 1:
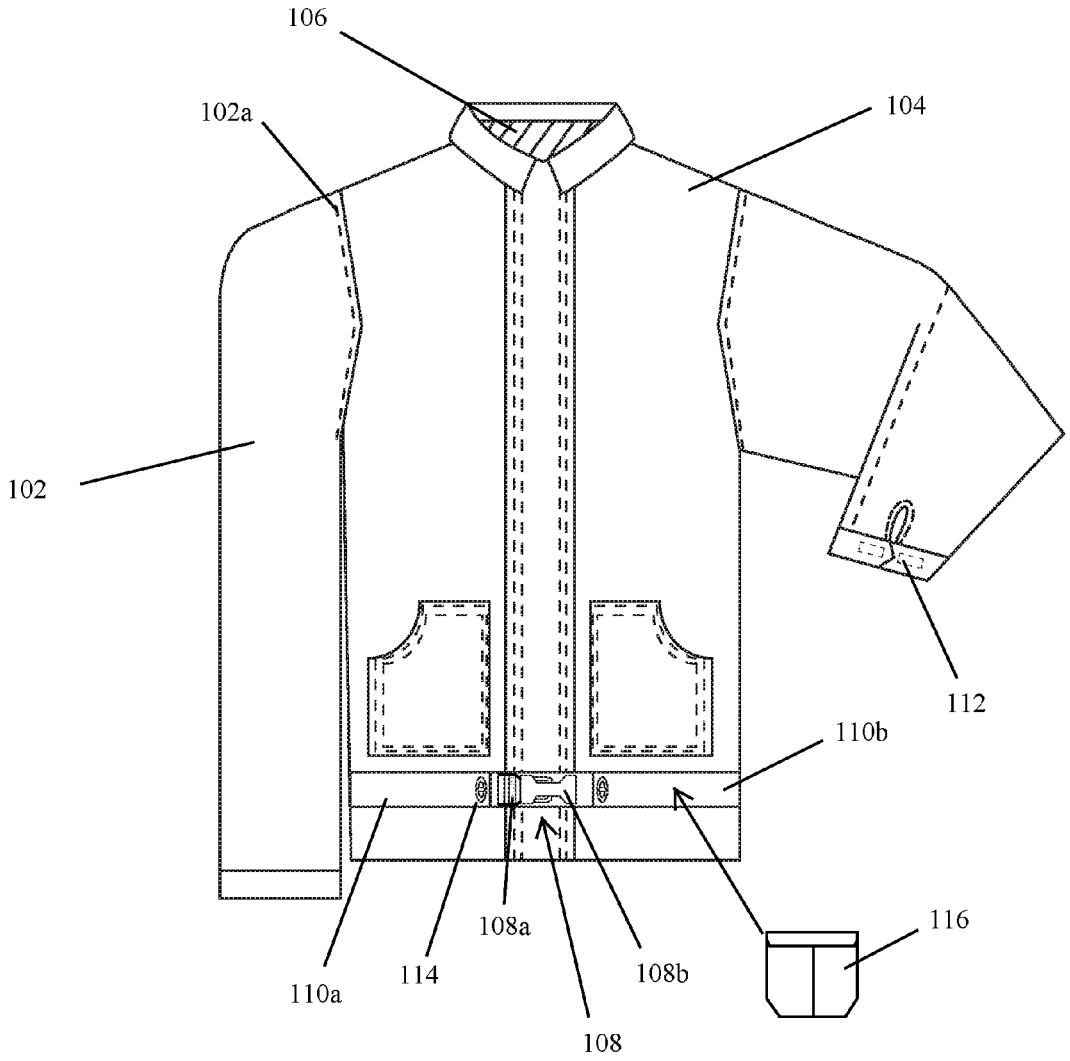
FIG. 1 is a front view of a load-bearing jacket, according to one embodiment of the disclosed invention.

The present disclosure relates to a load-bearing jacket that is used to aid persons who needs to carry tools and equipment on their bodies. Various embodiments of the load-bearing jacket will be described in detail with reference to the drawings, wherein like reference numerals represent like parts and assemblies throughout the several views. Reference to various embodiments does not limit the scope of the load-bearing jacket disclosed herein. Additionally, any examples set forth in this specification are not intended to be limiting and merely set forth some of the many possible embodiments for the load-bearing jacket. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

In one embodiment, the disclosed load-bearing jacket can enhance ease of access to various tools and equipment that are frequently carried on a person's body if the person is employed in a field of work such as construction, policework, military, or photography and will be outside in cold or cool weather. In one embodiment, the load-bearing jacket is made of heavy-duty cloth material and includes removable jacket sleeves 102, a vest shell 104, a removable vest liner 106, an integrated connector system 108, and an integrated tool belt system 110.

The heavy-duty cloth material used for the jacket can be duck cloth or any other heavy, plain-woven cotton or synthetic fabric. Heavy-duty cloth material is ideal because it is not prone to snagging or tearing, is able to efficiently block the wind, and is resistant to damage from long-term use. However, any other material that includes one, some, or all of these properties can also be used. In some embodiments, the jacket can include an external waterproof shell of synthetic material and an internal fleece (or other insulating) liner.

The load-bearing jacket can, in some embodiments, be made of several removable pieces. For example, the sleeves 102 on the load-bearing jacket can be removable. These sleeves 102 may be removably connected to the vest through the use of a connector such as, but not limited to, a zipper 102*a*, hook and loop fasteners, or buttons. Additionally, the sleeves 102 can be lined with an insulated liner. In some embodiments, the jacket does not have removable sleeves 102, but the sleeves 102 are still lined with an insulated liner. The opening of the sleeves 102 at the wrist area can have an adjustment feature 112, but may not have one. In one embodiment, the sleeves 102 can be tightened or loosened through the use of hook and loop fasteners attached at the wrist area of the sleeves 102. Other mechanisms may be employed for the adjustment feature 112 such as buttons, snaps, buckles, hook and clasp systems, or bungees.

In one embodiment, the load-bearing jacket can have a removable vest liner 106. The vest liner 106 can be insulated, such as through the use of a quilted pattern or feathers, and can attach to the vest shell 104 using connection means such as buttons, a zipper, or hook and loop fasteners. The vest shell 104 or, if the sleeves 102 are permanently affixed, the jacket, can be closed by means of, for example, a zipper, buttons, snaps, buckles, a hook and loop system, or a hook and clasp system. Further, the shell 104, the sleeves 102, or both can have pockets.

In a preferred embodiment, the jacket has an integrated connector system 108 that allows the user to tighten or loosen the jacket. This system can be a belt-buckle system (for example, a parachute buckle) or any other clasping system. In an example of a buckle system, as shown in FIG. 1, one end of each half of the buckle system is sewn onto the jacket, leaving the other ends free to connect with each other.

One or both ends of the buckle system 108*a*, 108*b* can be adjustable so that the jacket can be tightened or loosened at the user's waist.

Figure 2:
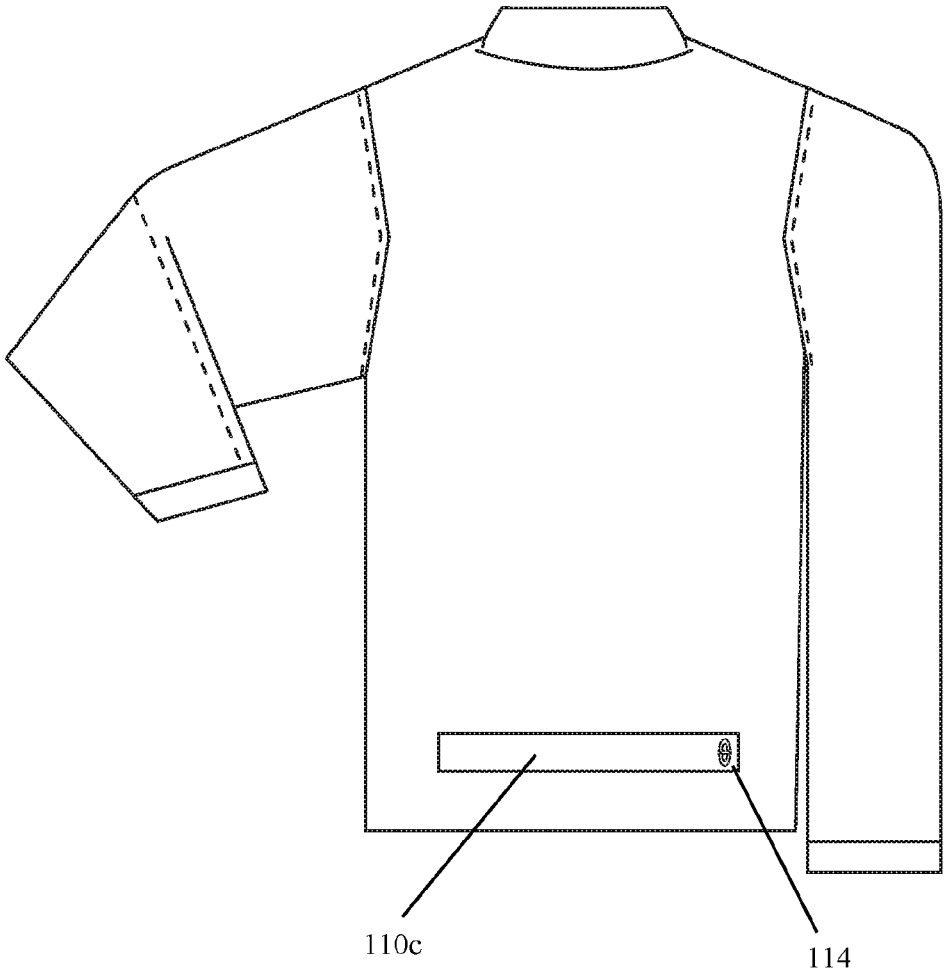
FIG. 2 is a back view of a load-bearing jacket, according to one embodiment of the disclosed invention.
Figure 3:
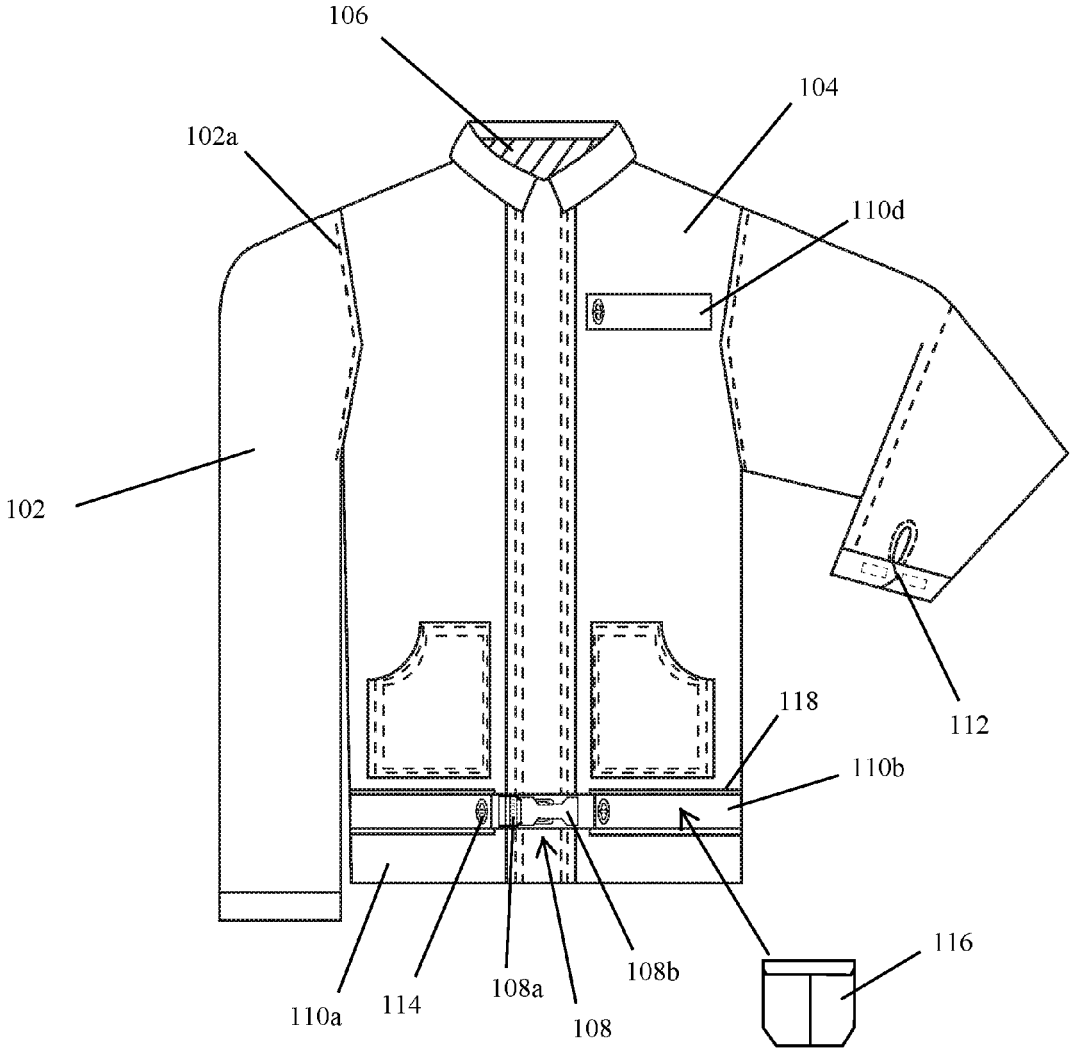
FIG. 3 is a front view of a load-bearing jacket, according to one embodiment of the disclosed invention.

In a preferred embodiment, the jacket includes an integrated tool belt system 110 that is connected horizontally at the waist of the vest portion of the jacket. The jacket can have a plurality of belt straps that make up the tool belt system 110. FIGS. 1 and 2 illustrate a tool belt system comprised of three belt straps, although fewer or more are possible. FIG. 1 illustrates a tool belt system 110 wherein the front of the tool belt system 110 includes one belt strap on the front right side of the jacket 110*a* and one belt strap on the front left side of the jacket 110*b*. FIG. 2 illustrates the back of a tool belt system 110 that includes one belt strap on the back of the jacket 110*c*. However, the tool belt system 110 can be comprised of more than three belt straps. Further, the belt straps can be at other locations on the jacket other than along the waist. For example, the jacket can have at least one belt strap at the chest level 110*d*. In some embodiments, the belt straps 110*a*-110*d* are removable, for example, through the use of a hook and loop system. In some embodiments, the belt straps 110*a*-110*d* may run vertically as opposed to horizontally.

In a preferred embodiment, the tool belt system 110 is made of belt straps 110*a*-110*d* that are intermittently sewn on, or otherwise permanently connected to, the jacket. Each belt strap 110*a*-110*d* can be sewn, or otherwise permanently connected, to the jacket on one end of the belt strap 110*a*-110*d*, leaving most of the length of the belt strap 110*a*-110*d* capable of hinging around the connected end. The other end of the belt strap 110*a*-110*d* can have a locking system 114, which enables a user to attach and detach at least one removable tool pouch 116 to the belt strap 110*a*-110*d*, as illustrated in FIG. 1. For example, using the locking system 114, a user can unlock one end of the belt strap 110*a*-110*d*, pull the belt strap 110*a*-110*d* away from the user's body, slide a loop of a tool pouch 116 onto the belt strap 110*a*-110*d*, close the belt strap 110*a*- 110*d*, and lock it, thereby securing the tool pouch 116 onto the belt strap 110*a*-110*d*. The locking system 114 can be, but is not limited to, a buckle (for example, a parachute buckle); a turn lock, as illustrated in FIG. 1; snaps; or a hook and loop system.

The belt straps 110*a*-110*d* of the tool belt system 110, in a preferred embodiment, are rigid due to the inclusion of, for example, a plastic piece or boning within a flexible part of the belt strap 110*a*-110*d*. The flexible portion of the belt strap 110*a*-110*d* can be made of nylon or another tough, flexible material. The flexible portion of the belt strap 110*a*-110*d* can, in one embodiment, encompass the rigid, plastic piece or the boning. Alternatively, the rigid portion of the belt strap 110*a*-110*d* can be attached to the outside material of the flexible portion.

In one embodiment, padded straps 118 can be sewn onto the jacket, on the inside or the outside of the jacket, to act as a barrier between the belt straps 110*a*-110*d* and the user, thus ensuring more comfort for the user. The padded straps 118 can be continuously or intermittently sewn on, or otherwise permanently connected, to the jacket. However, in a preferred embodiment, the padded straps 118 are not continuously sewn on, or otherwise completely connected, to the jacket so as to ensure less rigidity. In the case of an intermittent connection, the padded straps 118 can be connected similarly to how the belt straps 110*a*-110*d* are connected, wherein only the ends of the padded strap 118 are sewn, or otherwise permanently connected, to the jacket. However, unlike the belt straps 110*a*-110*d*, the padded straps 118 may not be capable of pivoting because both ends may be sewn, or otherwise permanently connected, to the jacket. In another embodiment, the padded straps 118 can attach and detach through a physical attachment system such as, but not limited to, buttons, snaps, buckles, zippers, a hook and loop system, or a hook and clasp system. In some embodiments, the locking system 114 of each belt strap 110*a*-110*d* can penetrate from the base of the jacket through the corresponding padded strap 118 and belt strap 110*a*-110*d*. In other embodiments, the locking system 114 of the belt strap 110*a*-110*d* can be permanently affixed to the outward facing portion of the padded straps 118.

The disclosed invention is capable of keeping a user warm during cold or cool weather. Further, due to the integrated belt straps 110*a*-110*d* and padded straps 118, there are fewer straps and the tool belt system 110 is less likely to be entangled on foreign objects. Additionally, the disclosed load-bearing jacket is more comfortable than current jackets that require a separate belt or suspender system because any movement of the user results in coordinated movement of the jacket and tool belt system 110.

The various embodiments described above are provided by way of illustration only and should not be construed to limit the claims attached hereto. Those skilled in the art will readily recognize various modifications and changes that may be made without following the example embodiments and applications illustrated and described herein and without departing from the true spirit and scope of the disclosure.

I claim:

1. A load-bearing jacket comprising:

an integrated connector system connected horizontally near a user's waistline when worn in an upright position; and an integrated tool belt system connected horizontally near the user's waistline when worn in an upright position;

wherein:

the integrated connector system includes an adjustable attachment point between left and right sides of the load-bearing jacket enabling the jacket to adjust in size;

the integrated tool belt system is comprised of:

a plurality of flexible belt straps that are connected horizontally and in line with each other; and a plurality of rigid pieces; and a plurality of padded straps, wherein each of the plurality of padded straps:

has a first end and a second end permanently connected to the load-bearing jacket, has a middle portion not connected to the jacket, thereby leaving a gap between an external surface of the jacket facing away from the wearer when worn, and each of the plurality of padded straps, is similar in shape and size to the plurality of flexible belt straps, and is located between the external surface of the jacket and a corresponding flexible belt strap; and each of the plurality of flexible belt straps has two ends, wherein a first end of each of the plurality of flexible belt straps is permanently connected to the external surface of the jacket and a second end of each of the plurality of flexible belt straps is connected to the external surface of the jacket by a locking system and designed to hinge around the first end of each of the plurality of flexible belt straps.

2. The load-bearing jacket of claim 1, wherein the integrated tool belt system includes three flexible belt straps, wherein a first flexible belt strap is located on a front right side of the jacket, a second flexible belt strap is located on a front left side of the jacket, and a third flexible belt strap is located on a back of the jacket.

3. The load-bearing jacket of claim 2, wherein each of the plurality of flexible belt straps are permanently connected to the padded straps on the first end and removably connected to the padded straps on the second end by the locking system.

4. The load-bearing jacket of claim 2, further comprising at least one belt strap near a user's chest.

5. The load-bearing jacket of claim 1, wherein each of the plurality of flexible belt straps hinges around the first connected end.

6. The load-bearing jacket of claim 5, wherein the locking system enables a removable tool pouch to be secured to one of the plurality of flexible belt straps by unlocking the one of the plurality of flexible belt straps from the jacket, rotating the one of the plurality of flexible belt straps away from the jacket, sliding an opening of the removable tool pouch onto the one of the plurality of flexible belt straps, rotating the one of the plurality of flexible belt straps toward the jacket, and locking the one of the plurality of flexible belt straps to the jacket.

7. The load-bearing jacket of claim 1, wherein the locking system is comprised of at least one buckle.

8. The load-bearing jacket of claim 1, further comprising:

an outer layer made of heavy-duty material;

removable jacket sleeves;

a vest shell; and a removable vest liner.

9. The load-bearing jacket of claim 8, wherein the heavy-duty material is selected from the group consisting of a heavy, plain-woven fabric, a duck cloth fabric, and combinations thereof.

10. The load-bearing jacket of claim 8, further comprising an external, waterproof shell.

11. The load-bearing jacket of claim 8, further comprising an insulating liner.

12. The load-bearing jacket of claim 8, wherein the removable jacket sleeves connect to the jacket using a zipper and the removable vest liner connects to the vest shell using buttons.

13. The load-bearing jacket of claim 1, wherein the integrated connector system is a belt-buckle system having a first buckle half and a second buckle half, wherein:

the first buckle half and the second buckle half each have a first end fixedly attached to the jacket;

the first buckle half has a second end connected to a male portion of a belt buckle;

the second buckle half has a second end connected to a female portion of the belt buckle; and at least one of the first buckle half or the second buckle half is adjustable to enable the jacket to be tighter or looser.

14. The load-bearing jacket of claim 1, wherein the integrated connector system is adjustable and is selected from the group consisting of a snap system, a hook system, a metal loop system, and combinations thereof.

15. The load-bearing jacket of claim 1, wherein each of the plurality of flexible belt straps encompasses each of the rigid pieces thereby making each of the plurality of flexible belt straps rigid.

16. The load-bearing jacket of claim 1, wherein each of the plurality of rigid pieces is attached to an outside portion of each of the plurality of flexible belt straps thereby making each of the plurality of flexible belt straps rigid.

17. The load-bearing jacket of claim 1, wherein the locking system is permanently affixed to an outward facing portion of the second end of each of the plurality of padded straps.

* * * * *